US010196800B2

(12) United States Patent
Hong et al.

(10) Patent No.: US 10,196,800 B2
(45) Date of Patent: Feb. 5, 2019

(54) MINERAL WATER SUPPLY MODULE

(71) Applicant: LG ELECTRONICS INC., Seoul (KR)

(72) Inventors: Jinpyo Hong, Seoul (KR); Myounghoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 387 days.

(21) Appl. No.: 14/956,744

(22) Filed: Dec. 2, 2015

(65) Prior Publication Data

US 2016/0160479 A1 Jun. 9, 2016

(30) Foreign Application Priority Data

Dec. 5, 2014 (KR) ..... 10-2014-0174006

(51) Int. Cl.
*E03B 7/07* (2006.01)

(52) U.S. Cl.
CPC ..... *E03B 7/075* (2013.01); *E03B 7/072* (2013.01); *E03B 7/074* (2013.01); *E03B 7/078* (2013.01)

(58) Field of Classification Search
CPC ..... E03B 7/075; E03B 7/074; E03B 7/072; E03B 7/078
See application file for complete search history.

(56) References Cited

U.S. PATENT DOCUMENTS 5,944,985 A * 8/1999 Bowman ..... B01D 61/08 210/153
7,060,170 B2 * 6/2006 Paul ..... F04B 17/00 204/450
7,597,790 B2 * 10/2009 Neyer ..... B01D 61/56 204/450
7,866,508 B2 * 1/2011 Feldman ..... B67D 1/0029 222/129.1
2011/0263752 A1 * 10/2011 Hiraishi ..... C09D 11/322 523/310

FOREIGN PATENT DOCUMENTS

CN 201280452 7/2009
CN 102107941 6/2011
(Continued)

OTHER PUBLICATIONS

Chinese Office Action dated Dec. 27, 2017 issued in Application No. 201510886274.X (with English Translation).
(Continued)

*Primary Examiner* — Regina M Yoo
(74) *Attorney, Agent, or Firm* — Ked & Associates, LLP

(57) ABSTRACT

A mineral water supply module may include a water supply pipe configured to supply water in a first direction, a mineral supply pipe configured to supply minerals in a second direction, a discharge pipe configured to discharge water or mineral water in the first direction, a resistance body case configured to connect to the mineral supply pipe and including a resistance body defining a micro channel in which minerals flow in the second direction, and a connector configured to connect the water supply pipe and the discharge pipe such that the resistance body case is provided between the water supply pipe and the discharge pipe and configured to allow the mixing of water from the water supply pipe and minerals from the resistance body case.

17 Claims, 5 Drawing Sheets

(56) References Cited

FOREIGN PATENT DOCUMENTS

| | | |
|---|---|---|
| CN | 202080964 | 12/2011 |
| CN | 202379791 | 8/2012 |
| CN | 103193308 | 7/2013 |
| DE | 35 00 394 | 7/1986 |
| EP | 1 857 415 | 11/2007 |
| JP | 10-328680 | 12/1998 |
| KR | 20-0197709 | 9/2000 |
| KR | 20-0396242 | 9/2005 |
| KR | 10-1209463 | 12/2012 |
| KR | 10-2014-0093256 | 7/2014 |

OTHER PUBLICATIONS

Korean Notice of Allowance dated May 18, 2016 issued in Application No. 10-2014-0174006 (with English Translation).

* cited by examiner

MINERAL WATER SUPPLY MODULE

CROSS-REFERENCE TO RELATED APPLICATION

This application claims priority under 35 U.S.C. § 119 to Korean Application No. 10-2014-0174006, filed on Dec. 5, 2014, whose entire disclosure is incorporated herein by reference.

BACKGROUND

1. Field

A drinking water supply device and a mineral water supply module of a drinking water supply device capable of providing drinking water containing minerals are disclosed herein.

2. Background

In general, a drinking water supply device may be a device that supplies drinking water to a user. The drinking water supply device may be a stand-alone device or may constitute part of an electric home appliance, such as, e.g., a refrigerator.

A drinking water supply device may supply drinking water at room temperature. The drinking water supply device may cool drinking water using a cold water supply unit that includes a refrigeration cycle or may heat drinking water using a heater. That is, the drinking water supply device may supply cold water or hot water to a user as needed.

Drinking water may be underground water, raw water supplied from a faucet, or filtered water obtained by filtering raw water. Drinking water may be defined as drinkable water.

Drinking water supply devices may be capable of providing water other than filtered water, cold water, or hot water. For example, the drinking water supply device may include a mineral water supply module that may be capable of providing mineral water that may contain a predetermined amount of minerals to a user.

Minerals may constitute one of the five types of nutritional substances along with protein, fat, carbohydrates, and vitamins. Minerals may play an important part in biochemical activity such as, e.g., catalytic activity, in the human body and in the constitution of, for example, the bones and teeth.

Mineral elements such as calcium (Ca), potassium (K), magnesium (Mg), and sodium (Na) may be important for metabolism. Mineral water that may contain these minerals may play a supporting role in improving health, for example, discharging waste matter from the human body and promoting digestion.

When a predetermined amount of minerals are in drinking water, the water may taste better than when the user drinks the water.

To make mineral water, an electro-analyzer, a mineral filter, or a device for directly supplying mineral liquid to filtered water, for example, may be applied to the drinking water supply device.

The device for directly supplying mineral liquid to filtered water may be more compact than other devices.

For example, the mineral water supply module for directly supplying condensed minerals to filtered water may be configured to have a structure in which minerals discharged from a mineral cartridge or container configured to store condensed mineral liquid may be supplied to a water discharge pipe through a mineral supply pipe.

As the mineral supply pipe of a conventional mineral water supply module may have a same inner diameter as the water discharge pipe, the amount of minerals supplied may easily vary due to the pressure from a pump configured to pressurize the mineral supply pipe.

That is, as the amount of minerals that are supplied varies, the concentration of minerals contained in mineral water that is discharged may vary. Thus, mineral water may taste differently whenever a user drinks the water.

In order to solve this problem, a flow rate adjustment unit or flow rate adjuster, for example, an orifice, may be used. As the amount of minerals that is required to generate or make mineral water may be very small, it may be difficult to manufacture a flow rate adjuster that may be capable of discharging a very small amount of minerals.

For example, if a drinking water supply device is configured to have a structure in which an inner diameter of a pipe used in the drinking water supply device is reduced so that a very small amount of minerals flow in the pipe, it may be difficult to manufacture the drinking water supply device. In addition, productivity may be lowered, and manufacturing costs may increase.

When energy is applied to minerals that exhibit high hardness, the minerals may crystallize and scale. The scale deposits may reduce the flow sectional area of the pipe. As a result, the flow of minerals may be obstructed, and a valve may malfunction.

For example, if the pipe has a reduced inner diameter such that a very small amount of minerals may flow through, the pipe may be easily clogged due to the scale deposits. Thus, there may be a high demand for a structure in which a pipe defining or providing a micro channel for discharging minerals may be easily maintained and replaced.

BRIEF DESCRIPTION OF THE DRAWINGS

The embodiments will be described in detail with reference to the following drawings in which like reference numerals refer to like elements wherein.

DETAILED DESCRIPTION

In the following description, water that has yet to pass through a filter may be defined as raw water, raw water that has passed through a filter may be defined as filtered or clean water, and filtered water containing minerals may be defined as mineral water. In addition, one end from which a fluid is introduced to a specific point may be referred to as a front end, and the other end to which the fluid is discharged from the specific point may be referred to as a front end.

Figure 1:
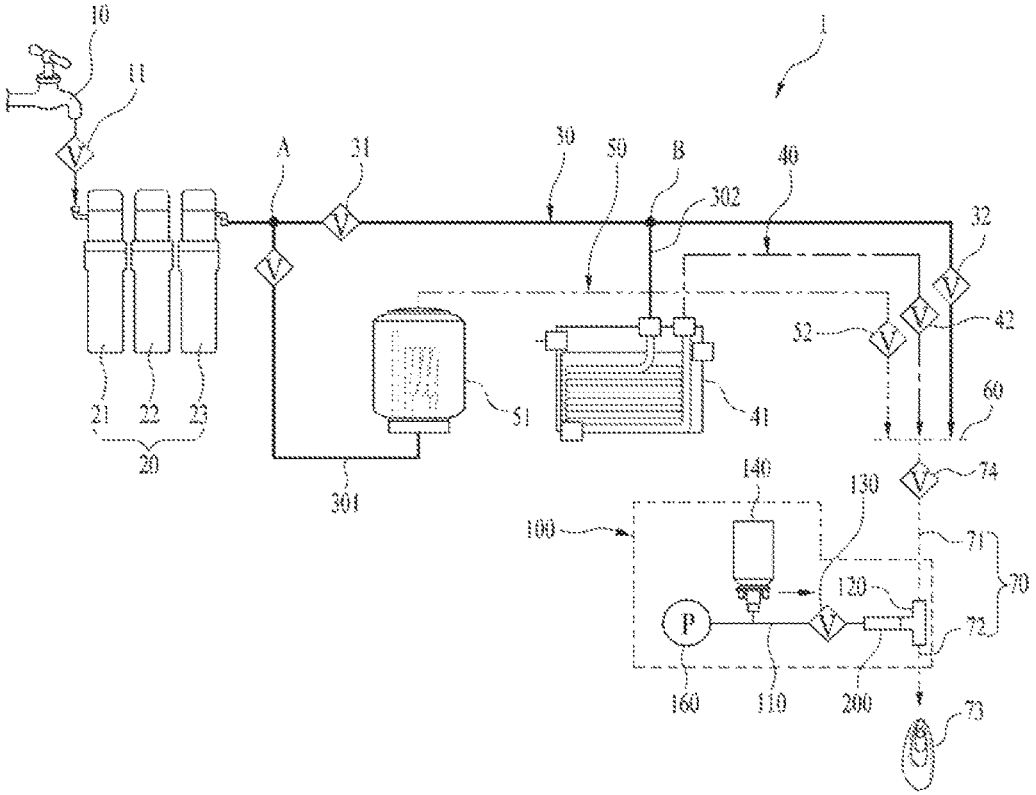
FIG. 1 is a conceptual view showing a drinking water supply device according to an embodiment.

FIG. 1 is a conceptual view of a drinking water supply device to which a mineral water supply module may be applied. The drinking water supply device 1 may convert raw water introduced into the drinking water supply device 1 through an external water tap 10 into filtered water using a filter unit 20. The construction of the filter unit 20 may vary. A plurality of single filters may constitute the filter unit 20. As shown in FIG. 1, three filters may be connected in series to one another to constitute the filter unit 20, but the embodiment is not limited thereto.

For example, the filter unit 20 may include a pre-carbon filter 21, an ultra-filtration (UF) filter 22, and a post-carbon filter 23. Other types of filters may also be added.

Filtered raw water or filtered water may be discharged out through a filtered water pipe 30, a filtered water supply valve 32, and a cock 73.

The drinking water supply device 1 may be configured to supply cold water or hot water. Heated filtered water, or hot water, may be discharged out of the drinking water supply device 1 through a first branch filtered water pipe 301 that may diverge from point A of the filtered water pipe 30, a heating unit 51, a hot water pipe 50, a hot water supply valve 52, and a cock 73.

Cooled filtered water, or cold water, may be discharged out of the drinking water supply device 1 through a second branch filtered water pipe 302 that may diverge from point B of the filtered water pipe 30, a cooling unit 41, a cold water pipe 40, a cold water supply valve 42, and the cock 73.

An embodiment in which filtered water, cold water, and hot water may be discharged through a single cock 73 is shown in FIG. 1. Cocks for discharging the filtered water, the cold water, and the hot water may be provided separately. The filtered water and the cold water may be discharged through one cock, and the hot water may be discharged through another cock, but embodiments are not limited thereto.

A cock valve 74 may be provided at a rear end of the filtered water supply valve 32, the cold water supply valve 42, and the hot water supply valve 52. The cock valve 74 may be connected to a distribution pipe 60. The distribution pipe 60 may be connected to the filtered water pipe 30, the cold water pipe 40, and the hot water pipe 50.

A water discharge pipe 70 through which filtered water, cold water, or hot water may be supplied may be provided at a rear end of the cock valve 74. Thus, filtered water, cold water, or hot water may be supplied into the distribution pipe 60. When the cock 73 is opened using the cock valve 74, the filtered water, the cold water, or the hot water may be selectively supplied through the water discharge pipe 70.

According to an embodiment disclosed herein, a mineral water supply module for generating mineral water may be connected to a water discharge pipe. The mineral water supply module 100 may be connected to a side of the water discharge pipe 70 via a connector 120, which is connected to the water discharge pipe 70.

Hereinafter, a portion of the water discharge pipe 70 located at a front end of the connector 120 and connected to the connector 120 may be referred to as a water supply pipe 71, and a portion of the water discharge pipe 70 connected to a rear end of the connector 120 may be referred to as a discharge pipe 72.

That is, the water supply pipe 71 may a pipe through which filtered water, cold water, or hot water may be selectively discharged and introduced into the connector 120 when the cock 73 is opened by the cock valve 74.

The discharge pipe 72 is a pipe through which the filtered water, the cold water, or the hot water having passed through the connector 120 or mineral water generated by the connector 120 may be selectively discharged to the cock 73. The mineral water supply module 100 may include a mineral supply pipe 110 configured to connect to the connector 120 to supply minerals.

The mineral supply pipe 110 may be provided with a mineral cartridge or container 140 configured to store condensed mineral liquid, a pump 160 configured to pressurize the mineral cartridge 140 to discharge minerals, and a mineral supply valve 130 to selectively supply minerals to the connector 120.

The concentration of minerals supplied from the mineral water supply module 100 to the connector 120 may high. The mineral cartridge 140 may store condensed mineral liquid in which minerals, e.g., calcium (Ca), potassium (K), magnesium (Mg), and sodium (Na), may be mixed. For example, the concentration of minerals in the condensed mineral liquid stored in the mineral cartridge 140 may be about 200 times the average concentration of minerals contained in filtered water.

The amount of condensed mineral liquid that may be required to synthesize or make mineral water with a taste that users' like may be extremely little. It may be necessary to uniformly supply a predetermined very small amount of minerals for a predetermined time and to provide a channel that may be capable of supplying a very small amount of minerals.

When energy is applied to minerals that exhibit high hardness, the minerals may crystallize and scale. Scale deposits may reduce the flow sectional area of the mineral supply pipe 110, and the flow rate of minerals may be reduced. The mineral supply pipe 110 through which a very small amount of minerals may flow may be clogged due to scale deposits, and the mineral water supply module may break down.

Figure 2:
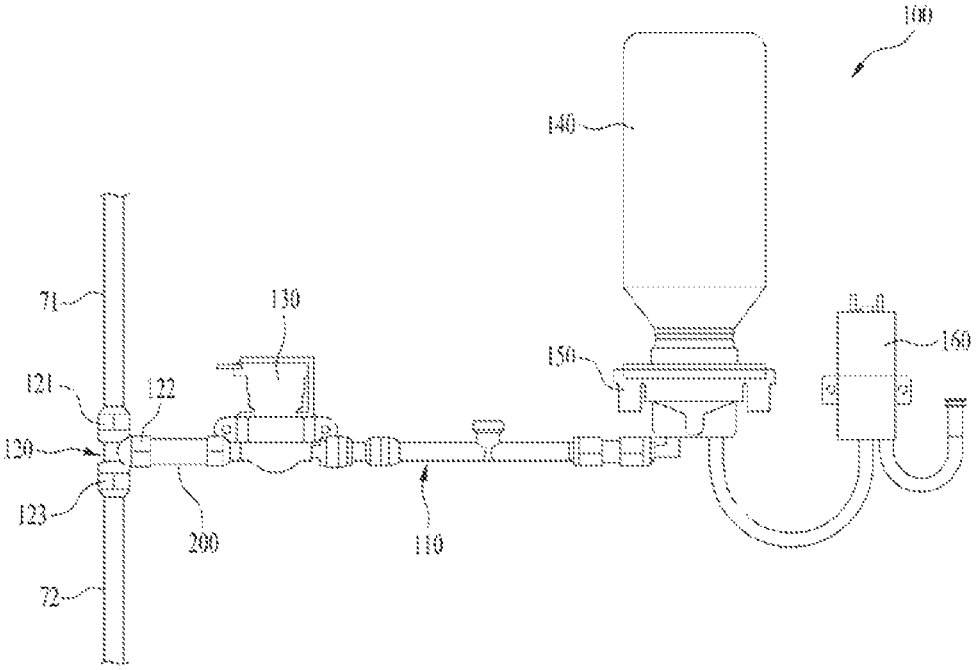
FIG. 2 is a schematic view of a mineral water supply module according to an embodiment.

Referring to FIG. 2, the mineral water supply module 100 according to an embodiment may include a water supply pipe 71 configured to supply filtered water, a mineral supply pipe 110 configured to supply minerals, and a discharge pipe 72 through which filtered water or filtered water containing minerals or mineral water may be selectively discharged based on whether or not the minerals are supplied.

A mineral cartridge 140 configured to store condensed minerals and a pump 160 configured to pressurize the mineral cartridge 140 or the mineral supply pipe 110 to discharge the minerals stored in the mineral cartridge 140 to the mineral supply pipe 110 may be connected to the mineral supply pipe 110.

In addition, a mineral supply valve 130 may be provided in the mineral supply pipe 110 configured to selectively open and close the mineral supply pipe 110 based on whether or not mineral water is to be generated. The mineral supply valve 130 may be provided in the mineral supply pipe 110 at a rear end of the mineral cartridge 140 such that the mineral supply valve 130 may be adjacent to the water supply pipe 71.

The mineral supply pipe 110 may be connected to a resistance body case 200. A resistance body 210 configured to generate a flow resistance may be inserted into the resistance body case 200 to provide or define a micro channel unit or micro channel 220 in which a very small amount of minerals may flow. The resistance body case 200 with the micro channel 220 may be provided at a rear end of the mineral supply valve 130 to adjust a flow rate of minerals supplied from the mineral supply pipe 110.

The mineral cartridge 140 may be connected to the mineral supply pipe 110 via a mineral cartridge receiver 150 configured to connect the mineral cartridge 140 to the mineral supply pipe 110. The mineral cartridge 140 may be detachably connected or coupled to the mineral cartridge receiver 150 such that the mineral cartridge 140 may be easily replaced when the minerals in the mineral cartridge 140 have been consumed or have not been used for a long time.

The mineral water supply module 100 according to the embodiment may be configured as a compact-sized module that includes the mineral supply pipe 110, the replaceable mineral cartridge 140, the pump 160, and the mineral supply valve 130. Thus, the mineral water supply module 100 may be applied to various drinking water supply devices.

The mineral water supply module 100 may further include a connector 120 in which filtered water supplied from the water supply pipe 71 and minerals supplied from the mineral supply pipe 110 may be mixed to generate mineral water.

Figure 3:
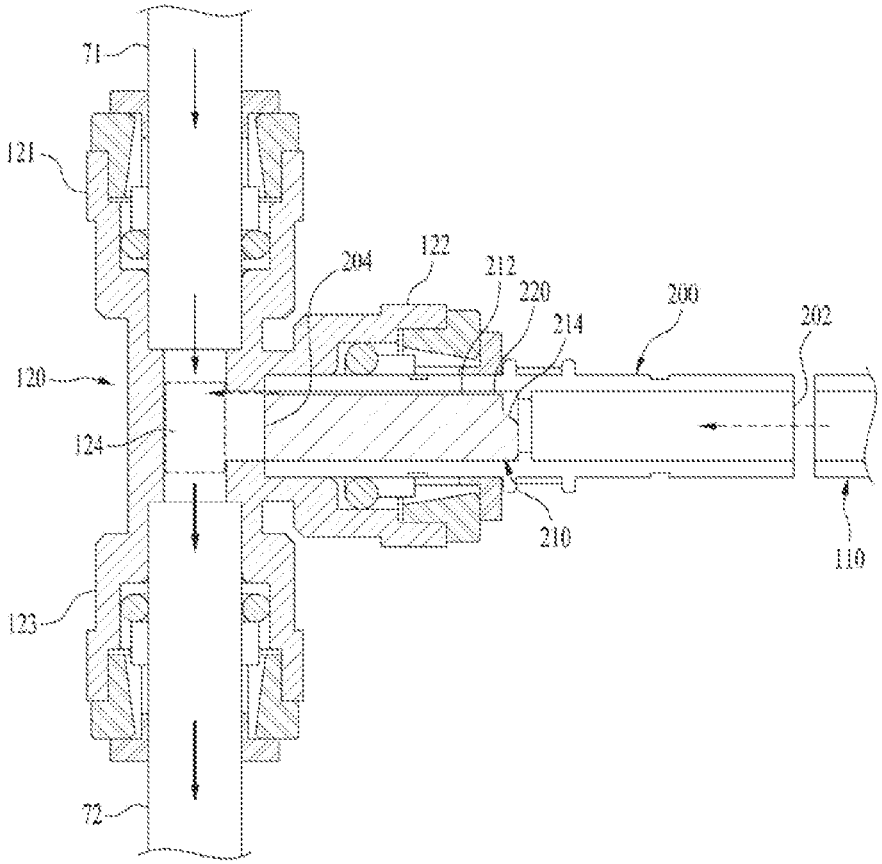
FIG. 3 is a sectional view showing a flow direction in a connector in which minerals may be mixed with filtered water according to an embodiment.

Referring to FIG. 3, the mineral water supply module 100 according to an embodiment may include a water supply pipe 71 configured to supply filtered water in a first direction and a mineral supply pipe 110 configured to supply minerals in a second direction different from the first direction. The mineral water supply module 100 may further include a discharge pipe 72 to discharge filtered water or filtered water containing minerals, or mineral water, based on whether or not the minerals are supplied.

The mineral water supply module 100 may further include a resistance body case 200 connected to the mineral supply pipe 110 and a resistance body 210 inserted into the resistance body case 200 to define or provide a micro channel 220 in which a very small amount of minerals flow in the second direction.

The mineral water supply module 100 may further include a connector for connecting the water supply pipe 71 to the discharge pipe 72 such that the resistance body case 200 may be provided between the water supply pipe 71 and the discharge pipe 72. A mixing space 124 in which minerals may be mixed with filtered water may be defined or provided in the connector 120 between the water supply pipe 71 and the resistance body case 200.

For example, the connector 120 may include a first connection part or connector 121 connected to the water supply pipe 71, a second connection part or connector 122 connected to the resistance body case 200, and a third connection part or connector 123 connected to the discharge pipe 72. The first connector 121 and the third connector 123 may be connected to each other in line. The first connector 121 and the second connector 122 may be connected to each other at a predetermined angle. The connector 120 may be T-shaped and configured to have a structure in which the second connector 122 may be connected perpendicularly to the first connector 121 and the third connector 123.

The mixing space 124 in which minerals may be mixed with filtered water may be defined or provided between the first connector 121 and the second connector 122. In the mixing space 124, filtered water flowing in the first direction and minerals flowing in the second direction collide with each other such that the minerals may be easily mixed with the filtered water. The flow in the first direction and the flow in the second direction may be perpendicular to each other in order to maximize mixing of the minerals and the filtered water.

In the third connector 123, filtered water or mineral water generated in the mixing space 124 may move in the first direction.

As shown in FIG. 3, the mineral water supply module 100 according to an embodiment may include a resistance body case 200 in the shape of a pipe that has a predetermined length. A first end of the resistance body case 200 may be connected to the second connector 122. A second end of the resistance body case 200 may be connected to the mineral supply pipe 110. Minerals from the mineral supply pipe 110 may be selectively supplied to the resistance body case 200 through the mineral supply valve 130.

The resistance body 210 may be inserted into the resistance body case 200 through a side of the resistance body case 200 that may be connected to the second connector 122. The resistance body 210 may generate a flow resistance in a mineral flow channel provided in the resistance body case 200 to define or provide a micro channel 220 in which a very small amount of minerals may flow.

That is, the resistance body 210, which may define or provide the micro channel 220, may be mounted in the resistance body case 200 connected to the second connector 122 and the mineral supply pipe 110 in order to more easily form the micro channel 220.

In addition, the resistance body case 200 may be connected to the second connector 122 and the mineral supply pipe 110 via a connection component, for example, a fitting that may be detachably connectable so as to easily maintain the micro channel 220.

When the micro channel 220 is clogged due to scale deposits, it may be possible to separate and replace only the resistance body case 200 so as to conveniently maintain the micro channel 220.

Figure 4A:
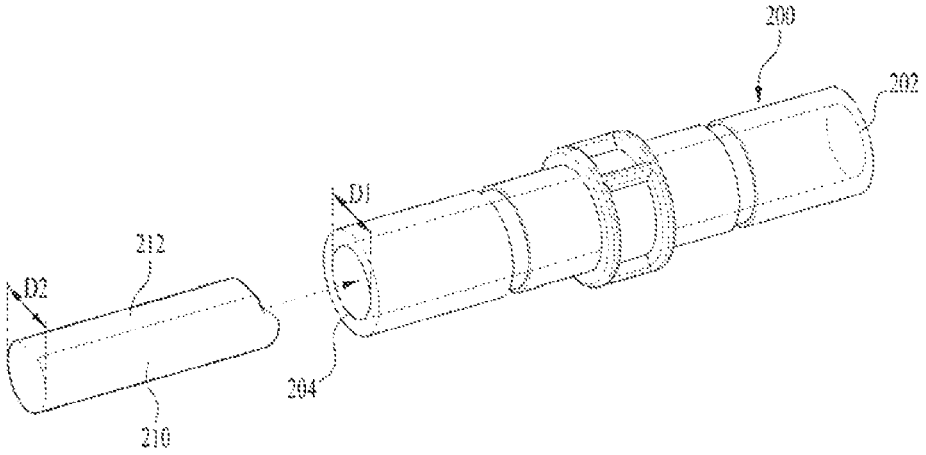
FIG. 4A is an exploded view of a resistance body and a resistance body case according to an embodiment.
Figure 4B:
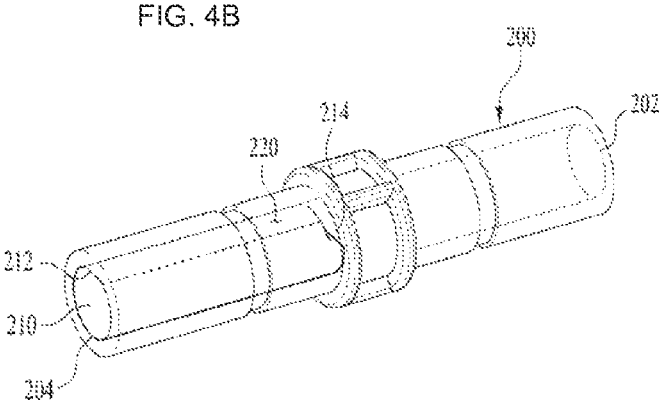
FIG. 4B is a perspective view of the resistance body mounted in the resistance body case of FIG. 4A.

Referring to FIG. 4, the resistance body 210 may be a cylindrical shape with a predetermined length. The resistance body 210 may have a cutoff part or portion 212 that may be formed by cutting a portion of an outer circumferential surface of the resistance body 210 in a longitudinal direction by a predetermined height such that the cutoff part 212 may extend in the longitudinal direction of the resistance body 210. That is, the cutoff part 212 formed at the portion of the outer circumferential surface of the resistance body 210 in the longitudinal direction may be flat. Thus, the cutoff part 212 may also define the micro channel 220 between the resistance body case 200 and the resistance body 210.

The resistance body case 200 may include an introduction end 202 connected to the mineral supply pipe 110. The introduction end 202 may have a same inner diameter as the mineral supply pipe 110. The resistance body case 200 may also include a discharge end 204 connected to the second connector 122 where the micro channel 220 may be defined.

An outer diameter D2 of the resistance body 210 may be greater than an inner diameter D1 of the resistance body case 200 such that the resistance body 210 may be inserted into the resistance body case 200. Thus, a remaining portion of the outer circumferential surface of the resistance body 210 extending in the longitudinal direction, where the cutoff part 212 is not formed, may contact the inner circumferential surface of the resistance body case 200 so as to prevent mineral leakage between the resistance body case 200 and the resistance body 210.

The resistance body 210 and the resistance body case 200 may be made of a synthetic resin, such as, e.g., acrylonitrile butadiene styrene (ABS), polyolefine (PO), or Noryl (R) modified polyphenylene oxide (MPPO). In addition, surfaces of the resistance body 210 and the resistance body case 200 may be smooth so the resistance body 210 may easily coupled into the resistance body case 200 and so reduction in pressure applied to minerals due to excessive frictional resistance may be prevented.

That is, the mineral flow channel of the resistance body case 200 may be blocked, excluding the micro channel 220 defined by the cutoff part 212 when the resistance body 210 is mounted in the resistance body case 200, such that minerals may flow only through the micro channel 220.

The micro channel 220 may be a polyhedral shape that has a predetermined flow sectional area and a predetermined length. The length of the micro channel 220 may be greater than the flow sectional area of the micro channel 220.

To supply a very small amount of minerals to the mixing space 124 for a predetermined time, the micro channel 220 may have a small sectional area. In addition, the micro channel 220 may have a length sufficient to reduce the pressure applied to the liquid.

If the micro channel 220 is formed within a predetermined length range, it may be possible to reduce the pressure applied to minerals flowing in the micro channel 220 so as to discharge a predetermined amount of minerals. In addition, it may be possible to reduce an effect caused by variation in pressure that may occur due to the operation of the pump 160.

For example, if the micro channel 220 has a length less than a lower limit of the predetermined length range, the reduction in pressure applied to the minerals flowing in the micro channel 220 may be small, and a larger amount of minerals than the predetermined amount of minerals may be discharged. That is, if the micro channel 220 is short, the pressure applied to minerals introduced from the mineral supply pipe 110 may not be reduced sufficiently due to frictional loss, and the amount of the minerals discharged may be greater than the predetermined amount of minerals to be discharged.

If the micro channel 220 is longer than an upper limit of the predetermined length range, the pressure applied to the minerals flowing in the micro channel 220 may be excessively reduced due to friction, and a smaller amount of minerals than the predetermined amount of minerals may be discharged. Thus, to discharge a fixed amount of minerals within an appropriate range, the micro channel 220 may have a corresponding appropriate length.

According to an embodiment disclosed herein, a mineral water supply module may alternately provide filtered water and mineral water.

As the resistance body case 200 may be provided between the connector 120 and the mineral supply valve 130 in the mineral water supply module 100, the micro channel 220 may remain filled with minerals even when the mineral supply valve 130 may be closed.

When filtered water is selected by the user after mineral water is discharged, minerals remaining in the micro channel 220 may move to the filtered water introduced from the water supply pipe 71.

Movement from high concentration to low concentration may occur in order to achieve natural equilibrium between materials. That is, as the difference in concentration of minerals between the filtered water and the condensed minerals may be great, the condensed minerals may move toward the filtered water in order to achieve concentration equilibrium.

Thus, the micro channel 220 according to the embodiment may function not only to discharge a very small fixed amount of minerals but also to minimize the discharge of minerals due to a concentration equilibrium phenomenon when filtered water is discharged.

That is, if the micro channel 220 has a sectional area sufficient to discharge a fixed amount of minerals and has a predetermined length sufficient to achieve a sufficient reduction in pressure, it may be possible to minimize the amount of minerals that may be discharged even when filtered water is supplied to the user. Even when filtered water is discharged after mineral water has been discharged, it may be possible to supply filtered water within the allowable deviation in taste. The sectional area and the length of the micro channel 220 may be optimized based on a system constituting the mineral water supply module 100 or by design.

Figure 5A:
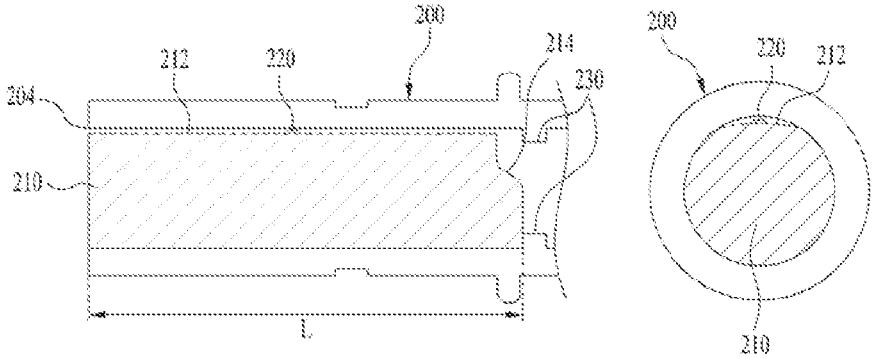
FIG. 5A is a partial sectional view and a front view of a resistance body mounted in a resistance body case according to an embodiment.

Referring to FIG. 5A, a first end of the resistance body 210 may be provided in the same plane as a discharge end 204 of the resistance body case 200, which may be adjacent to the mixing space 124.

A second end of the resistance body 210 may be provided by or at a protrusion 230 formed at an inside of the resistance body case 200. The protrusion 230 may protrude a predetermined height along an inner circumference of the resistance body case 200. In addition, the protrusion 230 may be spaced from the discharge end 204 of the resistance body case 20 by a length L of the resistance body 210.

During assembly, a first end of the resistance body 210 may be formed in the same plane as the discharge end 204 of the resistance body case 200 due to the protrusion 230. After assembly, the protrusion 230 may prevent the movement of the resistance body 210 in the longitudinal direction of the resistance body case 200.

The discharge end 204 of the resistance body case 200 may be inserted up to a stopper provided in the second connector 122 such that the discharge end 204 of the resistance body case 20 may be adjacent to the mixing space 124.

If the resistance body 210 is assembled or attached to the second connector 122 where the resistance body 210 protrudes out more than the discharge end 204 of the resistance body case 200, minerals may gather in a space between the protruding end of the resistance body 210 and the second connector 122.

If the resistance body 210 is assembled or attached to the second connector 122 where the resistance body 210 retreats in more than the discharge end 204 of the resistance body case 200, minerals may gather in a space between the end of the resistance body 210 and the discharge end 204 of the resistance body case 200.

Thus, a predetermined amount of minerals may not be supplied, and the gathering minerals may be instantaneously discharged due to a pressure difference. That is, a variation in minerals supplied may occur.

As the protrusion 230 may protrude a predetermined height along the inner circumference of the resistance body case 200, the flow of minerals introduced into the micro channel 220 may be blocked by the protrusion 230.

To prevent the introduction of minerals into the micro channel 220 from being blocked, a step 214, which may be spaced from the protrusion 230 by a predetermined distance, may be provided at a portion of the second end of the resistance body 210.

That is, a portion of the second end of the resistance body 210 may be spaced from the protrusion 230 by a predetermined distance such that minerals may be introduced into the micro channel 220, and the remaining portion of the second end of the resistance body 210 may contact the protrusion 230 such that the resistance body 210 may be positioned.

The step 214 may be formed such that a sectional area of the resistance body 210 may be minimized at the second end of the resistance body 210 contacting the protrusion 230. In addition, the step 214 may be formed such that the sectional area of the resistance body 210 may gradually increase in a direction in which minerals flow.

As the step 214 may be formed at the resistance body 210, the micro channel 220 may be formed even when the resistance body 210 is assembled in the resistance body case 200 at any angle, thus improving efficiency in assembly between the resistance body 210 and the resistance body case 200. In addition, as the sectional area of the step 214 may gradually increase, it may be possible to reduce the flow resistance of minerals introduced into the micro channel 220.

Figure 5B:
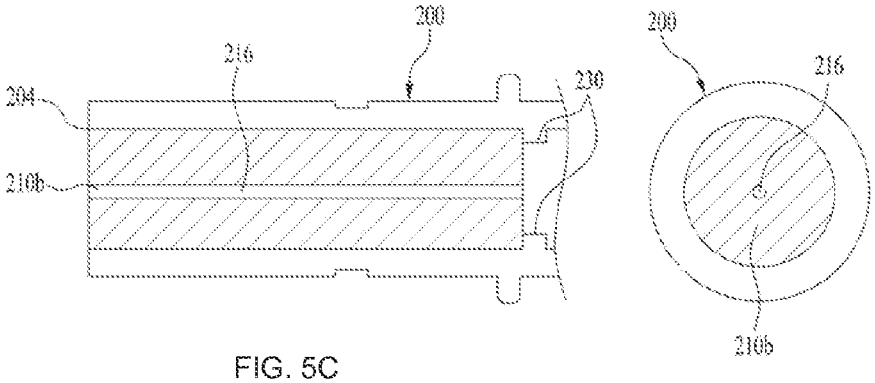
FIG. 5B is a partial sectional view and a front view of a resistance body mounted in a resistance body case according to another embodiment.

FIG. 5B is a partial sectional view and a front view of a resistance body case 200 and a resistance body 210*b* according to another embodiment. The resistance body 210*b* may be a cylindrical shape with a predetermined length. A hole 216 with a predetermined diameter may be provided in a longitudinal direction through the resistance body 210*b*.

The hole 216 may constitute a micro channel 220 in which a very small amount of minerals may flow. For example, the hole 216 may have a diameter of 0.5 mm to 1.0 mm. The hole 216 may have a minimum diameter of 0.5 mm, at which the resistance body 210*b* may be molded and machined such that the resistance body 210*b* may include the hole 216.

The maximum diameter of the hole 216 may be predetermined or set such that a predetermined very small amount of minerals may be supplied for a predetermined time. In addition, the diameter of the hole 216 may be predetermined or set such that filtered water may be discharged within an allowable deviation in taste after mineral water is discharged. That is, the diameter of the hole 216 may be predetermined or set such that the minerals remaining in the micro channel 220 may be introduced minimally into filtered water discharged after mineral water is discharged. For example, the maximum diameter of the micro channel 220 may be 1.0 mm.

In addition, the hole 216 may extend a predetermined length to adjust a flow rate of minerals discharged into the mixing space 124. The diameter and the length of the hole 216 may be optimized based on a system constituting the mineral water supply module 100 or by design.

Figure 5C:
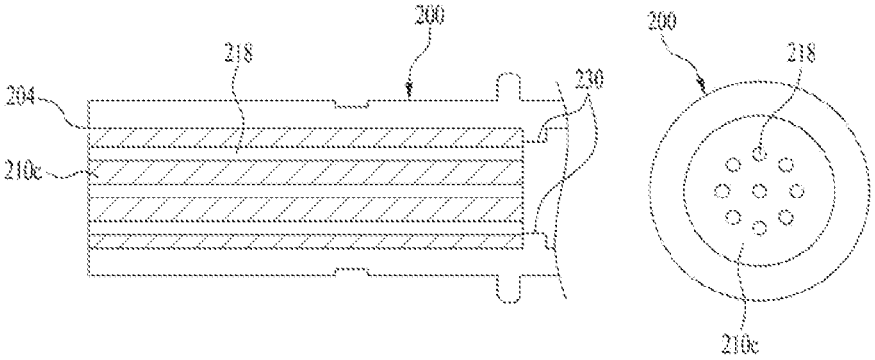
FIG. 5C is a partial sectional view and a front view of a resistance body mounted in a resistance body case according to a further embodiment.

FIG. 5C is a partial sectional view and a front view of a resistance body case 200 and a resistance body 210*c* according to a further embodiment. The resistance body 210*c* may be made of a porous material. In addition, the resistance body 210*c* may be a cylindrical shape with a predetermined length. A micro channel 220 may be provided through the resistance body 210*c*. The resistance body 210*c* may be provided with a plurality of small holes 218, which may constitute the micro channel 220.

As the resistance body may have various shapes, the resistance body may be selectively applied based on a system including the mineral water supply module.

According to embodiments disclosed herein, a mineral water supply module including a micro channel for supplying a very small amount of minerals, wherein the micro channel may have a simple structure and may be easily configured, thereby improving productivity, may be provided.

A mineral water supply module that may be easily maintained and replaced may be provided. In addition, a mineral water supply module configured such that a micro channel for supplying a very small amount of minerals may be easily and conveniently maintained and replaced may be provided.

A mineral water supply module capable of providing mineral water containing minerals within a predetermined concentration range may be provided.

A mineral water supply module capable of alternately providing mineral water and filtered water within an allowable deviation in taste may be provided.

A mineral water supply module capable of accelerating mixing of minerals with filtered water, thereby providing mineral water with consistent taste, may be provided.

In addition, a mineral water supply module having a compact size that may be easily applicable to various drinking water supply devices may be provided.

According to embodiments disclosed herein, a mineral water supply module may include a water supply pipe configured to supply water in a first direction, a mineral supply pipe configured to supply minerals in a second direction, a discharge pipe configured to discharge water or mineral water in the first direction based on whether or not minerals are supplied.

In addition, the mineral water supply module may further include a resistance body case configured to connect to the mineral supply pipe in order to supply a very small amount of minerals to the water supply pipe, the resistance body case including a resistance body defining a micro channel, in which minerals flow in the second direction.

The micro channel may be defined as a result of an assembly between the resistance body and the resistance body case. The resistance body may be inserted into the resistance body case where the resistance body may be provided at the outer circumferential surface thereof with a space in which minerals flow, thereby achieving easy manufacture and improving productivity.

In addition, the mineral water supply module may further include a connector configured to connect the water supply pipe and the discharge pipe such that the resistance body case is provided between the water supply pipe and the discharge pipe and configured to allow mixing of water from the water supply pipe and minerals from the resistance body case.

The connector may include a first connector configured to connect to the water supply pipe, a second connector configured to connect to the resistance body case, and a third connector configured to connect to the discharge pipe. The connector may be T-shaped and configured to connect the water supply pipe with the discharge pipe in line and to provide the resistance body case between the water supply pipe and the discharge pipe.

The resistance body case may be connected to the second connector and the mineral supply pipe via a connection component, for example, a fitting, which may be detachably connectable so as to easily and conveniently maintain or replace the micro channel.

The mixing space may be configured such that the flow of the filtered water in the first direction and the flow of the minerals in the second direction mix the filtered water and the minerals in a mixing space in the connector.

The resistance body may be in a cylindrical shape having a predetermined length and may have a cutoff part formed by cutting a portion of the resistance body in a longitudinal direction by a predetermined height such that the micro channel may be defined between the resistance body case and the resistance body.

The resistance body may have an outer diameter greater than an inner diameter of the resistance body case such that the resistance body may be inserted into the resistance body case.

That is, the resistance body may have the micro channel defined by the cutoff part, and the remaining portion of the outer circumferential surface of the resistance body, at which the cutoff part is not formed, may contact the inner circumferential surface of the resistance body case so as to prevent mineral leakage between the resistance body case and the resistance body.

One end of the resistance body may be formed in the same plane as a discharge end of the resistance body case that may be adjacent to the mixing space so as to prevent minerals from gathering in a space defined between the resistance body and the resistance body case.

The resistance body case may be provided with a protrusion extending along the inner circumference of the resistance body case to prevent the resistance body from moving in a longitudinal direction of the resistance body case. In addition, the protrusion may contact the other end of the resistance body to position the resistance body.

The resistance body may be provided at a portion of the other end with a step, which may be spaced from the protrusion by a predetermined distance, in order to prevent minerals introduced into the micro channel from being blocked.

The step may prevent the introduction of minerals into the micro channel from being blocked due to the protrusion, and the micro channel may be formed due to the step even when the resistance body may be assembled in the resistance body case at any angle, thereby improving efficiency in assembly between the resistance body and the resistance body case.

In addition, the step may be formed at the other end of the resistance body contacting the protrusion such that the sectional area of the resistance body gradually increases in a direction in which minerals flow so as to reduce the flow resistance of minerals introduced into the micro channel.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A mineral water supply module comprising:

a water supply pipe configured to supply water in a first direction;

a mineral supply pipe configured to supply minerals in a second direction;

a discharge pipe configured to discharge water or mineral water in the first direction;

a resistance body case configured to connect to the mineral supply pipe, the resistance body case including a resistance body defining a micro channel in which minerals flow in the second direction; and a connector configured to connect the water supply pipe and the discharge pipe such that the resistance body case is provided between the water supply pipe and the discharge pipe and configured to allow mixing of water from the water supply pipe and minerals from the resistance body case, wherein the resistance body case is provided with a protrusion extending along an inner circumference of the resistance body case to prevent the resistance body from moving in a longitudinal direction of the resistance body case.

2. The mineral water supply module according to claim 1, further comprising:

a mineral cartridge configured to connect to the mineral supply pipe to store condensed minerals;

a pump configured to pressurize an interior of one of the mineral cartridge or the mineral supply pipe to discharge minerals to the mineral supply pipe; and a mineral supply valve provided in the mineral supply pipe configured to selectively open and close to supply minerals to the resistance body case.

3. The mineral water supply module according to claim 1, wherein the connector includes a first connection part configured to connect to the water supply pipe, a second connection part configured to connect to the resistance body case, and a third connection part configured to connect to the discharge pipe.

4. The mineral water supply module according to claim 1, wherein the flow of the water in the first direction and the flow of the minerals in the second direction mix the minerals and the water in a mixing space in the connector.

5. The mineral water supply module according to claim 4, wherein the flow in the first direction and the flow in the second direction are perpendicular to each other.

6. The mineral water supply module according to claim 1, wherein the resistance body is in a cylindrical shape that has a predetermined length and a cutoff part formed by cutting a portion of the resistance body in a longitudinal direction by a predetermined height such that the micro channel is defined between the resistance body case and the resistance body.

7. The mineral water supply module according to claim 6, wherein the resistance body is provided at a portion of one end with a step spaced from the protrusion by a predetermined distance in order to prevent minerals introduced into the micro channel from being blocked.

8. The mineral water supply module according to claim 7, wherein the step is formed at one end of the resistance body contacting the protrusion such that an area of a section of the resistance body gradually increases in a direction in which minerals flow.

9. The mineral water supply module according to claim 6, wherein the resistance body case has an inner diameter greater than an outer diameter of the resistance body such that the resistance body is inserted into the resistance body case.

10. The mineral water supply module according to claim 9, wherein the other end of the resistance body is formed in the same plane as a discharge end of the resistance body case adjacent to a mixing space of the connector.

11. The mineral water supply module according to claim 1, wherein the resistance body is in a cylindrical shape that has a predetermined length and a hole with a predetermined diameter in a longitudinal direction through the resistance body, wherein the hole constitutes the micro channel.

12. The mineral water supply module according to claim 11, wherein the resistance body case has an inner diameter greater than an outer diameter of the resistance body such that the resistance body is inserted into the resistance body case.

13. The mineral water supply module according to claim 12, wherein the other end of the resistance body is formed in the same plane as a discharge end of the resistance body case adjacent to a mixing space of the connector.

14. The mineral water supply module according to claim 1, wherein the resistance body is in a cylindrical shape that has a predetermined length, is made of a porous material, and has a plurality of holes provided through the resistance body, wherein the plurality of holes constitute the micro channel.

15. The mineral water supply module according to claim 14, wherein the resistance body case has an inner diameter greater than an outer diameter of the resistance body such that the resistance body is inserted into the resistance body case.

16. The mineral water supply module according to claim 15, wherein the other end of the resistance body is formed in the same plane as a discharge end of the resistance body case adjacent to a mixing space of the connector.

17. The mineral water supply module according to claim 1, wherein the water supplied by the water supply pipe is filtered water.

* * * * *